US005574474A

United States Patent [19]

Tamanoi

[11] Patent Number: 5,574,474

[45] Date of Patent: Nov. 12, 1996

[54] LIQUID CRYSTAL DRIVING CIRCUIT

[75] Inventor: Yutaka Tamanoi, Kawasaki, Japan

[73] Assignee: Kabushiki Kaisha Toshiba, Kanagawa-ken, Japan

[21] Appl. No.: 251,664

[22] Filed: May 31, 1994

Related U.S. Application Data

[63] Continuation of Ser. No. 798,010, Nov. 26, 1991, abandoned.

[30] Foreign Application Priority Data

Nov. 27, 1990 [JP] Japan ..... 2-320946

[51] Int. Cl.[6] ..... G09G 3/36

[52] U.S. Cl. ..... 345/95; 345/100

[58] Field of Search ..... 340/811, 813, 340/802, 793; 307/243, 264, 268, 125, 130, 126, 75, 72, 242; 323/367, 369, 393, 298, 297; 359/57, 59, 60; 345/100, 98, 95, 210, 212, 211, 38, 50, 51, 52; 341/144, 153

[56] References Cited

U.S. PATENT DOCUMENTS

| | | | |
|---|---|---|---|
| 3,744,049 | 7/1973 | Luce | 340/811 |
| 4,158,786 | 6/1979 | Hirasawa | 340/802 |
| 4,848,876 | 7/1989 | Yamakawa | 340/813 |
| 5,070,255 | 12/1991 | Shin | 307/264 |

*Primary Examiner*—Jeffery Brier

*Attorney, Agent, or Firm*—Finnegan, Henderson, Farabow, Garrett & Dunner, L.L.P.

[57] ABSTRACT

In a liquid crystal driving circuit according to the present invention, a variable resistor is provided between each of power lines and an output terminal to control the driving ability of this circuit. The resistivity of this resistor can be changed in analog or in digital. In the digital case, the variable resistor can be formed with a constant resistor and a by-pass switch. In order to increase the variable stages of the liquid crystal driving ability of the circuit, a plurality of combinations, each of which is comprised of said constant resistor and said by-pass switch, are provided between each of power lines and the output terminal.

2 Claims, 4 Drawing Sheets

LIQUID CRYSTAL DRIVING CIRCUIT

This application is a continuation of application Ser. No. 07/798,010, filed Nov. 26, 1991, now abandoned.

BACKGROUND OF THE INVENTION

1. Field of the Invention

This invention relates to a liquid crystal driving circuit. More particularly, it relates to a liquid crystal driving circuit in which the ability to drive a liquid crystal panel is variable.

2. Description of the Prior Art

With the technical progress of liquid crystal displays, to enlarge the screen and to improve the display quality have become important technical themes for a liquid crystal display. For these themes, the matching between a liquid crystal driving circuit and a liquid crystal panel is very important. When a liquid crystal panel is driven by a driving circuit, there arises two kind of matchings. That is, the voltage matching and the current matching. It is well-known that the voltage matching depends on the driving duty ratio. On the other hand, for the current matching, the following should be arranged precisely to obtain the best display quality: characteristics of liquid crystal materials in a panel and wiring materials; characteristics of the connectivity between a panel and a liquid crystal driving circuit; operating environments (for example, the operating temperature, and the brightness around an operating place; and the quality of electric supply for a liquid crystal driving circuit. Presently, the precise arrangement to improve the display quality is typically carried on by characteristic tuning of liquid crystal materials. To realize this approach, however, it is necessary to prepare several kind of liquid crystal panels which are to be used for the evaluation of liquid crystal panel, and then, to choose one of them according to conditions. Thus, time and money are wasted to find suitable conditions for the selection of panels, and so, the degree of freedom in the arrangement becomes small.

A liquid crystal driving circuit of the prior art will be explained next with referring to a drawing. In FIG. 1, a schematic diagram of a liquid crystal driving circuit according to the prior art is shown. As shown in the figure, the circuit is comprised of the following: the first power line 1; the second power line 2; the third power line 3; the fourth power line 4; output switching means 5; an output selecting circuit 6; and an output terminal 7 to drive a liquid crystal. In the driving circuit mentioned above, four power lines 1, 2, 3, and 4 are connected to output terminal 7 through switching means 5 which is controlled by output selecting circuit 6. Thus, when one switch in output switching means 5 conducts, the voltage corresponding to the power line is appeared on output terminal 7 selectively to drive a liquid crystal.

The prior art driving circuit mentioned above is connected to a liquid crystal panel to compose a liquid crystal display, and select a suitable voltage which should be applied to drive the liquid crystal panel. When a voltage is selected to output from the circuit shown in FIG. 1, however, the current capacity applied to a liquid panel is decided unconditionally from the impedance of four power lines 1, 2, 3, and 4, the conduction resistivity of output switching means 5, and the resistivity of wiring between each power line and output terminal 7. Thus, there is no room to arrange the current capacity mentioned above. In other words, the driving ability for a liquid crystal is fixed.

As mentioned above, in the liquid crystal driving circuit according to the prior art, the current capacity applied to a liquid crystal panel, or the driving ability for a liquid crystal panel is fixed, and therefore, it cannot be arranged. As a result, the current matching between the liquid crystal driving circuit and the liquid crystal panel becomes very difficult. In reality, in order to carry out the current matching, characteristic tunings of liquid crystal materials should be used. However, such tunings waste time and money, and the degree of freedom in the tunings is very small.

SUMMARY OF THE INVENTION

This invention has been made to overcome the above mentioned problems of the prior art driving circuit for a liquid crystal.

One objective of the present invention is, therefore, to provide a liquid crystal driving circuit in which the ability to drive a liquid crystal panel is variable.

Another objective of the present invention is to provide a liquid crystal driving circuit in which the current matching to realize high display quality is carried out easily in a short time and with a low price.

One feature of the present invention is to provide a liquid crystal driving circuit which is comprised of the following: a plurality of power lines; a liquid crystal driving output terminal; an output selecting circuit to decide which of the power lines should be connected to the output terminal; output switching means which are inserted between each of the power lines and the output terminal, and to connect between the output terminal and the power line which is designated by the output selecting circuit; and variable resistor means which is inserted between the power lines and the output terminal, and to change the output value from the output terminal.

Another feature of the present invention is in the fact that the value of the variable resistor means can be changed in digital or in analog.

According to the features of this invention, the current which flows out from the output terminal can be controlled by changing the value of the variable resistor means. Thus, the current matching between the driving circuit and a liquid crystal panel is easily accomplished in this invention. Also, said control is possible once the liquid crystal driving circuit of this invention has been incorporated in a real liquid crystal display. Therefore, a liquid crystal display having the best display quality is obtained in a short time and with a low price by using the liquid crystal driving circuit of this invention.

These and other objects, features and advantages of the present invention will be more apparent from the following description of preferred embodiments, taken in conjunction with the accompanying drawings.

DETAILED DESCRIPTION OF PREFERRED EMBODIMENTS

Figure 1:
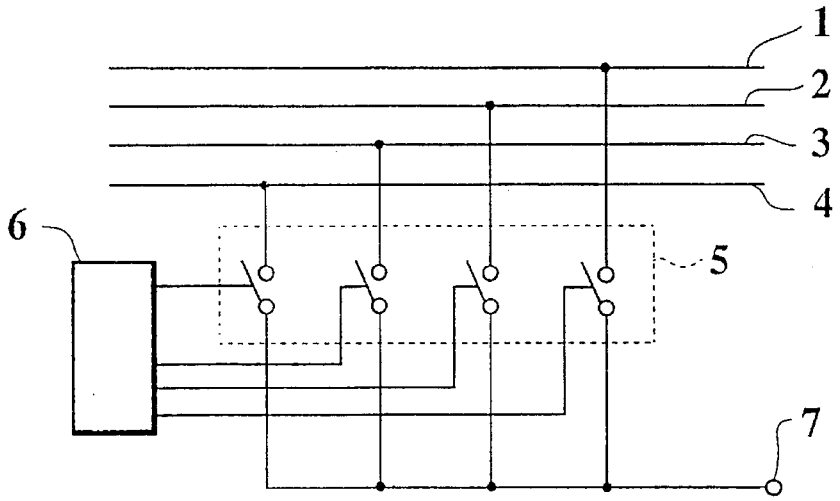
FIG.1 PRIOR ART
FIG. 1 is a circuit diagram of the liquid crystal driving circuit according to a prior art of the present invention.
Figure 2:
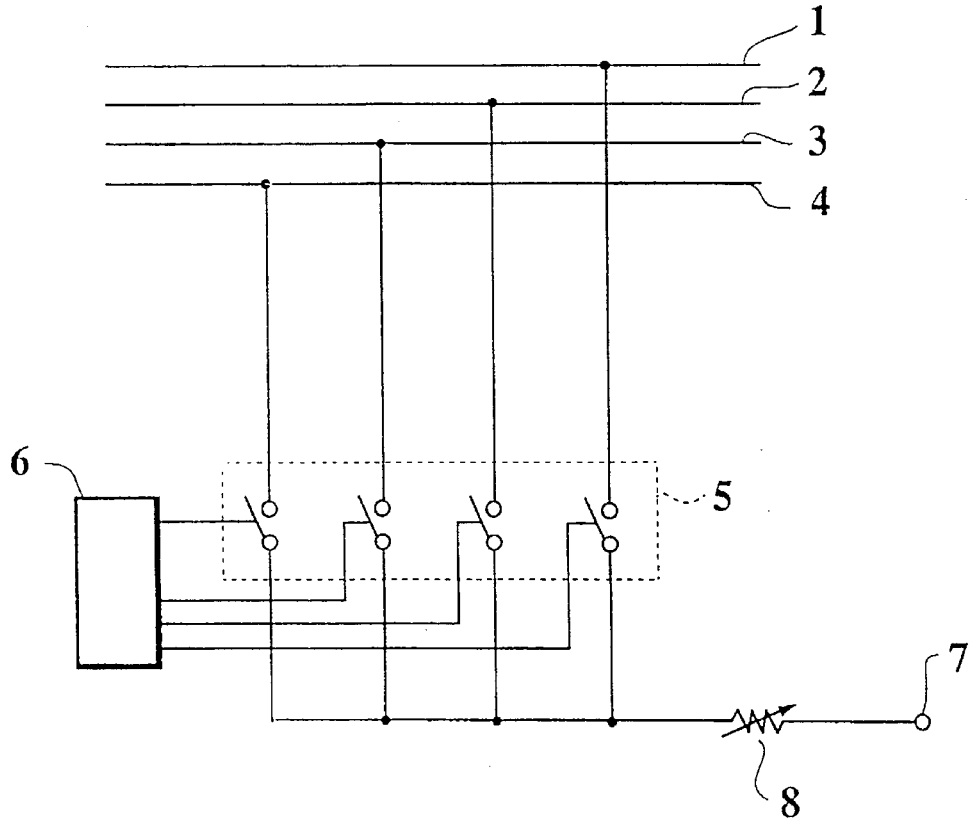
FIG. 2 is a circuit diagram of the liquid crystal driving circuit according to the first embodiment of the present invention.

FIG. 2 is a schematic diagram showing the liquid crystal driving circuit according to the first embodiment of the present invention. In this figure, the same numbers as those shown in FIG. 1 indicate the same or the like structure members, so that their explanation will be omitted.

In this embodiment as shown in FIG. 2, the first power line 1, the second power line 2, the third power line 3, and the fourth power line 4 are connected to liquid crystal driving output terminal 7 through output switching means 5, which is controlled by output selecting circuit 6, and a variable resistor 8 which is to limit the driving ability of this circuit. When one of the switches in output switching means 5 becomes conductive as the result of selection by output selecting circuit 6, the voltage of the corresponding power line among the first, second, third, and fourth power lines appears selectively at output terminal 7 as the driving voltage for a liquid crystal.

According to the above mentioned structure, variable resistor 8 limits the current which flows out to the liquid crystal panel from output terminal 7, when one of the voltages from the power lines is selected to output from output terminal 7. In this instance, the more ohms of variable resistor 8, the less driving ability is obtained. On the contrary, when the value of resistor 8 is 0, the maximum driving ability is obtained from the driving circuit. As mentioned above, in the driving circuit of this embodiment, the driving ability for a liquid crystal panel can be varied by changing the resistivity of variable resistor 8.

Figure 3:
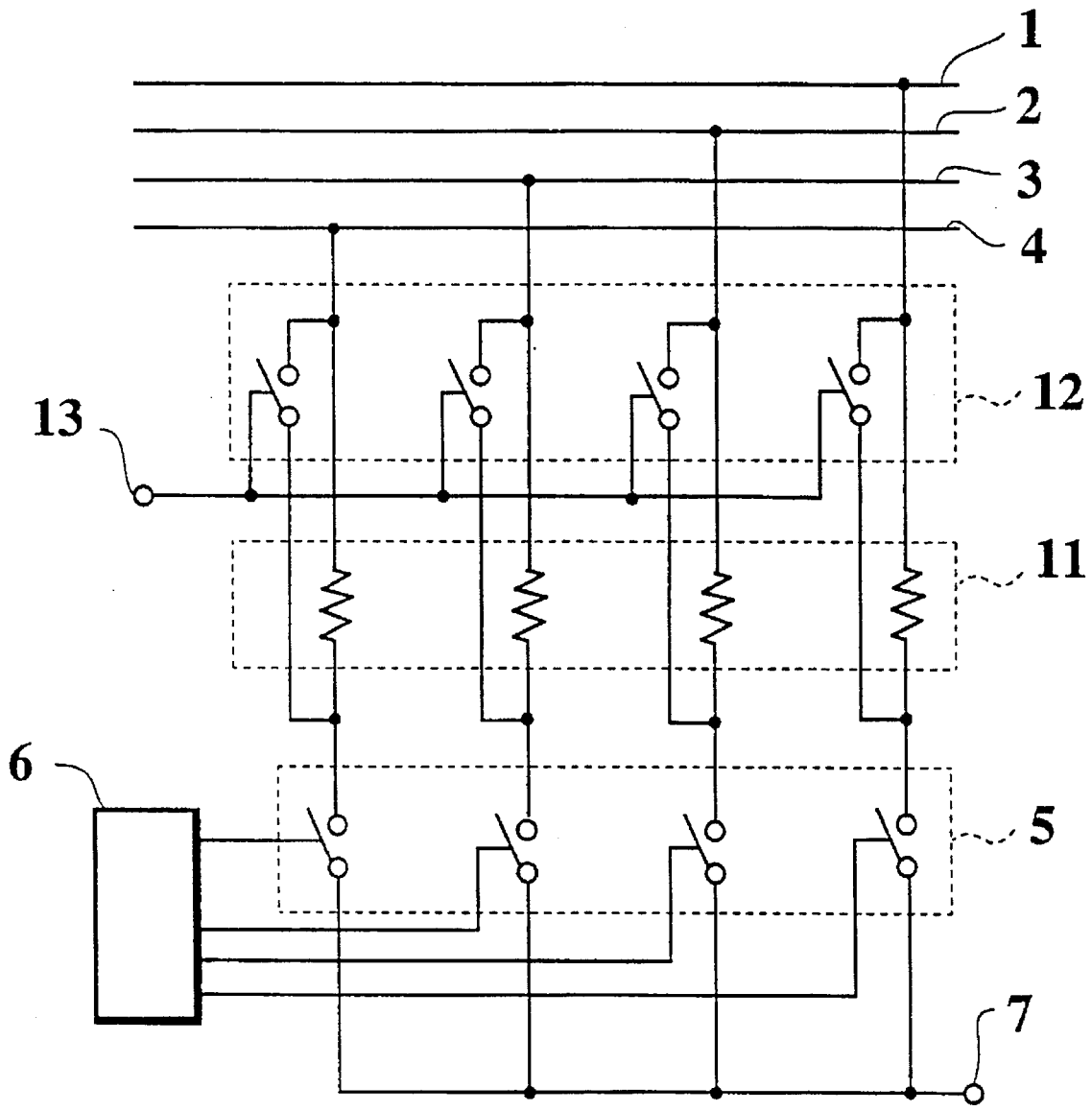
FIG. 3 is a circuit diagram of the liquid crystal driving circuit according to the second embodiment of the present invention.

FIG. 3 is a schematic diagram showing tile liquid crystal driving circuit according to the second embodiment of the present invention.

In this embodiment as shown in the figure, the first, second, third, and fourth power lines 1, 2, 3, and 4 are connected to liquid crystal driving output terminal 7 through driving ability switching means 12, driving ability limiting resistor 11, and output switching means 5. The switching means 12 by-passes driving ability limiting resistor 11 by being controlled with a driving ability control input 13. Also, said output switching means 5 is controlled by output selecting circuit 6. Thus, when one of the switching elements in output switching means 5 becomes conductive due to the selection by output selecting circuit 6, the corresponding voltage among the four power lines appears selectively at output terminal 7 to drive a liquid crystal. In this embodiment, driving ability limiting resistor 11 having a constant resistivity is provided to allow for assembling the circuit into an integrated circuit. In reality, resistor 11 is connected to the respective power line by the control of driving ability switching means 12 which is controlled by the input through driving ability control input 13. As a result, ability to drive a liquid crystal panel is controlled digitally in this embodiment.

According to the above mentioned structure, the driving ability is set to the maximum value when driving ability switching means 12 is closed. On the other hand, the driving ability falls when switching means 12 is open. The degree of the fall is fixed unconditionally from the resistivity value of driving ability limiting resistor 11.

As mentioned above, in this embodiment, the ability to drive a liquid crystal panel can be changed, depending on by-passing or not by-passing driving ability limiting resistor 11.

Figure 4:
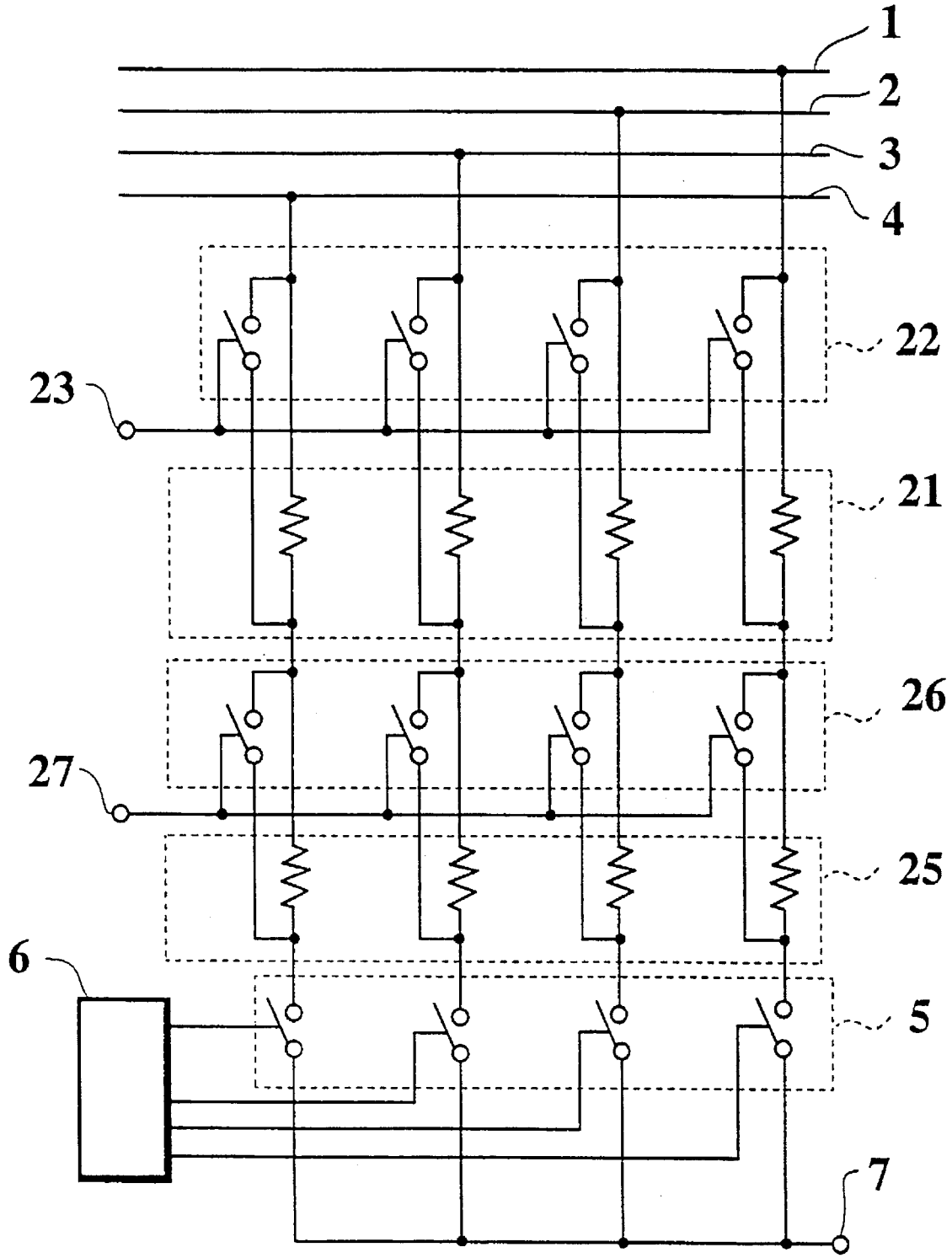
FIG. 4 is a circuit diagram of the liquid crystal driving circuit according to the third embodiment of the present invention.

FIG. 4 is a schematic diagram showing the liquid crystal driving circuit according to the third embodiment of the present invention.

In this embodiment, as shown in the figure, the following is provided between the four power lines 1, 2, 3, and 4 and liquid crystal driving output terminal 7. FIG. 4 shows the following: driving ability limiting resistors 21; driving ability switching means 22 which is controlled by driving ability control input 23 so as to by-pass said driving ability limiting resistors 21; driving ability limiting resistor 25 which is connected in series to said driving ability limiting resistor 21 and driving ability switching means 22; driving ability switching means 26 which is controlled by driving ability control input 27 so as to by-pass said driving ability limiting resistors 25; and output switching means 5 which is controlled by output selecting circuit 6.

In the circuit mentioned above, when one of the switching elements in output switching means 5 is closed, that is, conductive, due to the selection by output selecting circuit 6, the corresponding voltage among the four power lines appears at output terminal 7 to drive a liquid crystal. This embodiment has been developed from the second embodiment about the following point. That is, in order to increase the variation stages of the driving ability in the circuit of the second embodiment, two circuits, each of which is comprised of limiting resistor 11, switching means 12, and control input 13, are provided in series between the four power lines and output terminal 7.

In the second embodiment, the degree of fall in the the driving ability is fixed unconditionally from the magnitude of limiting resistor 11. In this embodiment, however, the degree of the fall in the driving ability can be changed into about three stages, by setting the values of resistors 21 and 25 differently. In other words, the ability is varied in three stages due to the combination of the settings of inputs 23 and 27. Also, if switching means 22 and 26 are both closed according to the control of outputs 23 and 27, the ability to drive a liquid crystal panel is maximized because both limiting resistors are by-passed. As a whole, then, the ability to drive a liquid crystal panel can be changed into 4 stages.

The second embodiment can be developed in the following point. That is, to increase the number of variable stages in the driving ability, more than two circuits, each of which is comprised of limiting resistor 11, switching means 12, and control input 13 can be provided in series between four power lines and output terminal 7.

Figure 5:
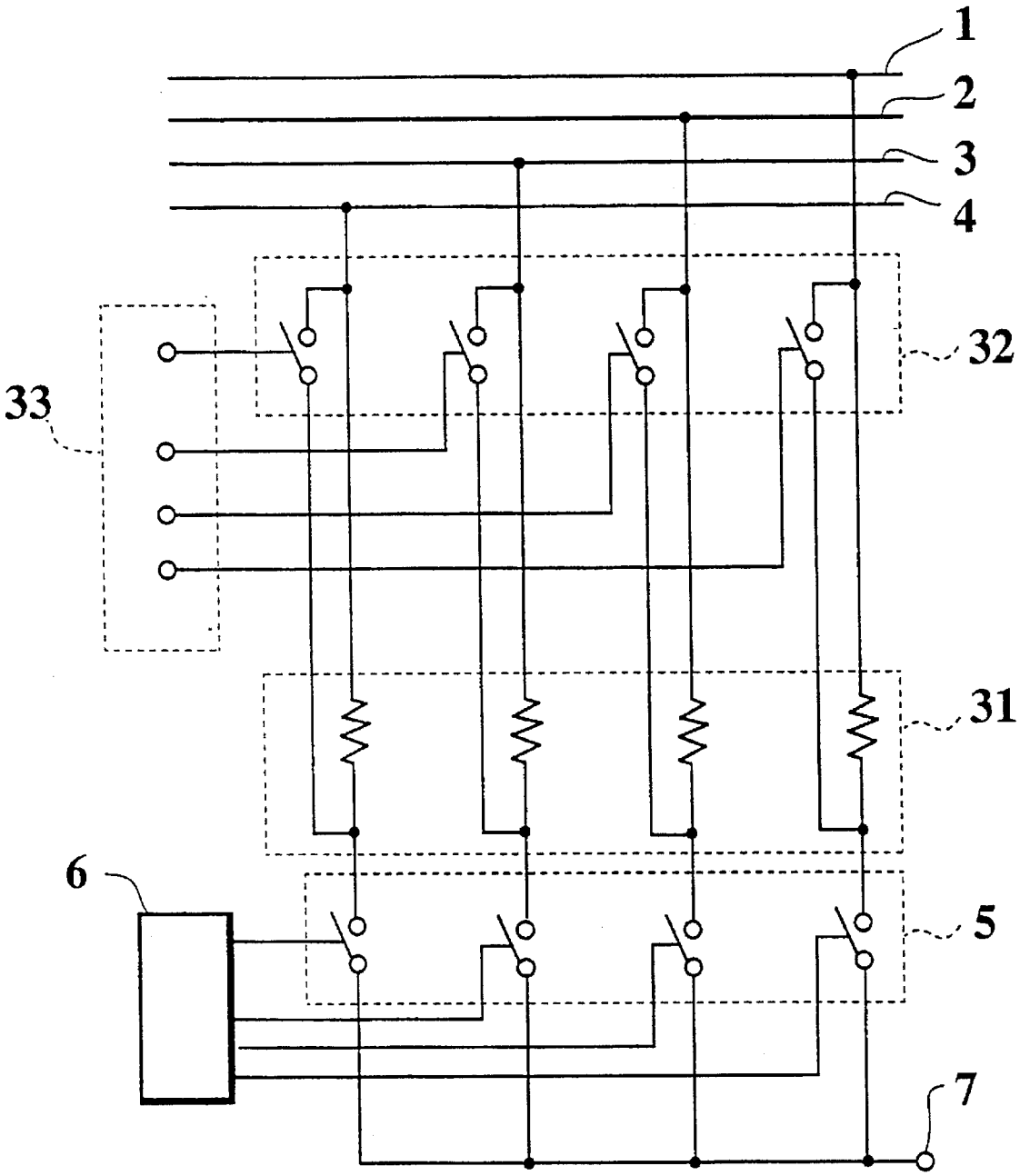
FIG. 5 is a circuit diagram of the liquid crystal driving circuit according to the fourth embodiment of the present invention.

FIG. 5 is a schematic diagram showing the liquid crystal driving circuit according to the fourth embodiment of the present invention.

In this embodiment, as shown in the figure, the following is provided between four power lines and output terminal 7: driving ability limiting resistors 31; driving ability switching means 32 in which each switching element is controlled separately by driving ability control input 33 so as to by-pass said limiting resistors 31; and output switching means 5 which is controlled by output selecting circuit 6. In this circuit, when one of the switching elements in output switching means 5 is selected to become conductive by output selecting circuit 6 and set conductive, the corresponding voltage among four power lines appears selectively at output terminal 7. This embodiment is characterized in the fact that, in limiting resistors 31, the connection of each resistor element can be fixed independently, that is, whether or not to limit the driving ability is determined independently for each element. Also, the driving ability can be predetermined digitally according to the control of driving ability control input 33.

In summary, according to the present invention, a variable resistor to limit the driving ability of a liquid crystal is provided between each power line and a liquid crystal driving output, and the resistivity of this resistor is made changeable in digital or in analog. So, a liquid crystal driving circuit in which the ability to drive a liquid crystal panel can be changed easily, is obtained according to the present invention.

Also, if the current matching in the liquid crystal driving circuit of the present Invention is carried out while varying the ability to drive a liquid crystal panel, only one evaluation set is required, thus saving evaluation time and cost. Furthermore, the arrangement of the driving ability can be carried out after the circuit is incorporated in a finished product, that is, a liquid crystal display. Therefore, the product can be arranged so as to obtain the best display quality depending on the change of operating environment.

Recently, failure in liquid crystal driving circuits have been recognized as a serious problem according to the development of liquid crystal displays. One of the reasons of the wrong operations is due to the noise which is generated at the switching of driving voltages. On the other hand, as the size of a display screen becomes large, a high driving voltage is required. With such a high voltage, the noise problem becomes very serious. In order to cope with this noise problem, the flowing current at the switching is reduced in this invention by arranging the ability to drive a liquid crystal panel. In the case when one kind of liquid crystal driving circuit is applied to a various kind of liquid crystal displays, said noise influence among the displays may be varied according to the variation of their peripheral equipments. It is possible, in the liquid crystal driving circuit of this invention, to cope with the variation of noise influence by arranging the ability to drive a liquid crystal panel. Therefore, one kind of liquid crystal driving circuit of this invention can be massproduced to reduce the production cost.

What is claimed is:

1. A liquid crystal driving circuit for providing different voltages comprising:

a plurality of power lines for supplying different voltages;

means connected With said power lines for selectively outputting the voltage of one of said power lines through an output terminal; and a plurality of pairs of resistors and switches, a respective pair of a resistor and a switch of said plurality of pairs connected in parallel between said means for selectively outputting and a respective one of said power lines, the resistor of said pair being selectively shorted by the switch of said pair in order to adjust a current passing from said power line through said output terminal, wherein the switches of the plurality of pairs of resistors and switches are independently driven by separate respective signals.

2. A liquid crystal display driving circuit comprising:

a plurality of terminal means for receiving a like purality of different voltages and having an output terminal connectable to a liquid crystal display to supply a particular one of said plurality of voltages to the liquid crystal display, output switching means including a plurality of terminals, each connectable to a respective one of said plurality of terminal means, said output switching means connected to said output terminal for switching the particular voltage to the output terminal;

a plurality of pairs of resistors and switches, each pair including a resistor and a switch connected in parallel and connecting a respective one of said plurality of terminal means to said connectable respective one of said plurality of terminals of said output switching means, the resistor of each said pair being selectively shorted by the switch of said pair in order to adjust a current passing from the respective connected one of said plurality of terminal means through said output switching means to said output terminal; and signal line means for driving the switches of the plurality of pairs of resistors and switches independently.

* * * * *